US008115578B2

(12) United States Patent
Fancke

(10) Patent No.: US 8,115,578 B2
(45) Date of Patent: Feb. 14, 2012

(54) RELAY

(76) Inventor: Alan R Fancke, Victoria (AU)

( * ) Notice: Subject to any disclaimer, the term of this patent is extended or adjusted under 35 U.S.C. 154(b) by 342 days.

(21) Appl. No.: 12/373,211

(22) PCT Filed: Jul. 10, 2007

(86) PCT No.: PCT/AU2007/000947
§ 371 (c)(1),
(2), (4) Date: Jan. 9, 2009

(87) PCT Pub. No.: WO2008/006147
PCT Pub. Date: Jan. 17, 2008

(65) Prior Publication Data
US 2010/0001820 A1 Jan. 7, 2010

(30) Foreign Application Priority Data
Jul. 10, 2006 (AU) ..... 2006903682

(51) Int. Cl.
*H01H 51/22* (2006.01)

(52) U.S. Cl. ..... 335/78; 335/132; 335/202

(58) Field of Classification Search ..... 335/78–86, 335/124, 128, 132, 202
See application file for complete search history.

(56) References Cited

U.S. PATENT DOCUMENTS

| | | | | |
|---|---|---|---|---|
| 4,006,322 | A * | 2/1977 | Gallatin et al. | 200/16 A |
| 5,834,998 | A | 11/1998 | Reiss et al. | |
| 5,907,268 | A * | 5/1999 | Mader | 335/202 |
| 6,661,321 | B1 * | 12/2003 | Chuang | 335/132 |
| 2005/0190026 | A1 * | 9/2005 | Mikl | 335/128 |

FOREIGN PATENT DOCUMENTS

| | | | |
|---|---|---|---|
| EP | 0997998 | A1 | 5/2000 |
| WO | WO 99/54973 | A1 | 10/1999 |

* cited by examiner

*Primary Examiner* — Bernard Rojas
(74) *Attorney, Agent, or Firm* — Edwin D. Schindler

(57) ABSTRACT

An electromechanical relay includes a case and a relay module, in which the case has terminals to enable a connection into the circuit to be protected and connectors which cooperate with complementary connectors on the relay module to enable the relay to readily be connected to the external circuit. The relay also has an arrangement in which the fixed contacts are directly associated with the connectors on the module and the movable contacts are associated therewith, and can be provided as either normally open or normally closed contacts.

14 Claims, 3 Drawing Sheets

RELAY

TECHNICAL AREA

This invention relates to a relay, in particular, to an electro-mechanical relay designed specifically for applications where high performance and reliability is paramount.

BACKGROUND TO THE INVENTION

Electro-mechanical relays have, of course, been used for many years. These relays have offered a substantial number of alternative operative conditions, such as normally on, normally off contacts, or a combination of these, trip means which may include a flag and may have a reset operation which could be electrical, mechanical, or both.

Normally, these relays have been individually designed and manufactured for the particular purpose and this often necessitates a number of different types of components and, particularly, from the point-of-view of the manufacturer, carrying substantial stocks-of relays having various characteristics.

OUTLINE OF THE INVENTION

The object of the present invention is to provide and electro-mechanical relay in which the operative components, and particularly the moveable contacts, can be such that there is provided a relay which can readily be set-up to provide a number of different characteristics.

In particular, the moveable contacts can be located on a member whereby they can be located and calibrated before connection to a relay body and wherein they can selectively be provided to operate under normally open, normally closed, or a combination of both conditions.

The invention includes a relay, having means whereby the various components are basically modular and can be readily assembled to provide such different operations.

In particular, the relay can provide contacts which are normally open or which are normally closed, using effectively the same components, and can also provide an arrangement whereby there is a double-make or double-break arrangement of contacts which can increase the isolation between open contacts and increase the current break-rating.

The arrangement also provides means whereby the number of electrical terminations which need to be made during assembly of the relay are limited.

In particular operations, we may provide a relay which, once tripped, retained in that condition until it is reset and the reset can be by means either of a physical reset button, an electrical reset or both.

There may also be provided a physical flag to indicate the condition of the relay.

DESCRIPTION OF AN EMBODIMENT OF THE INVENTION

In order that the invention may be more readily understood, there shall be described In relation to the accompanying drawings, one particular embodiment of relay.

Figure 1:
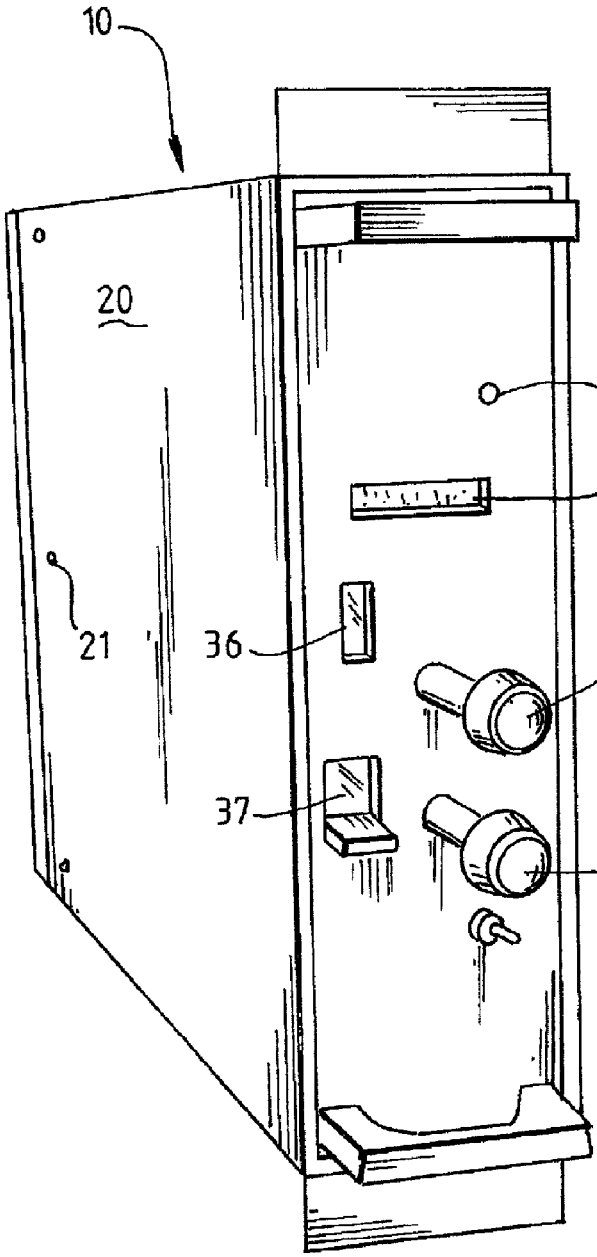
FIG. 1 is a view of the relay located in the draw out case.
Figure 2:
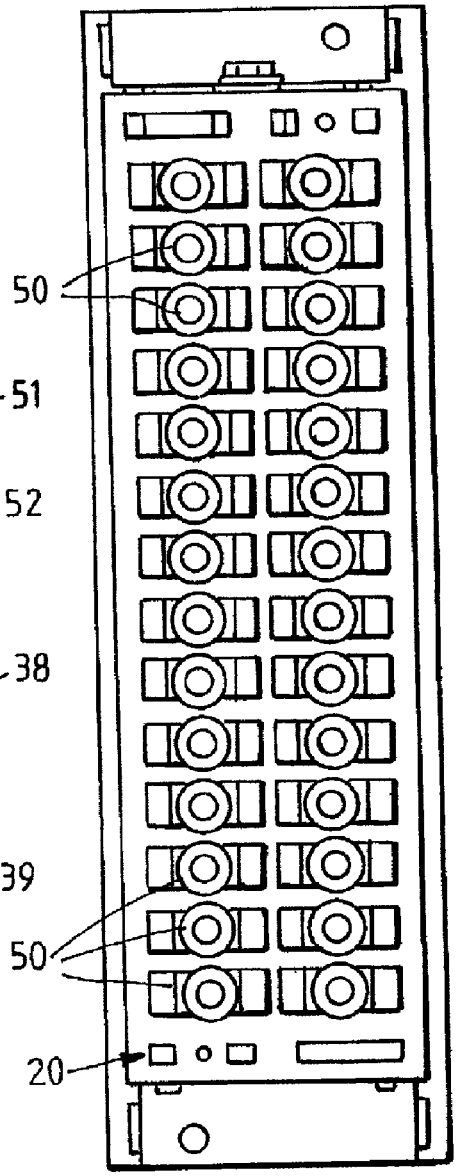
FIG. 2 is a rear view of the case showing the terminal layout.
Figure 3:
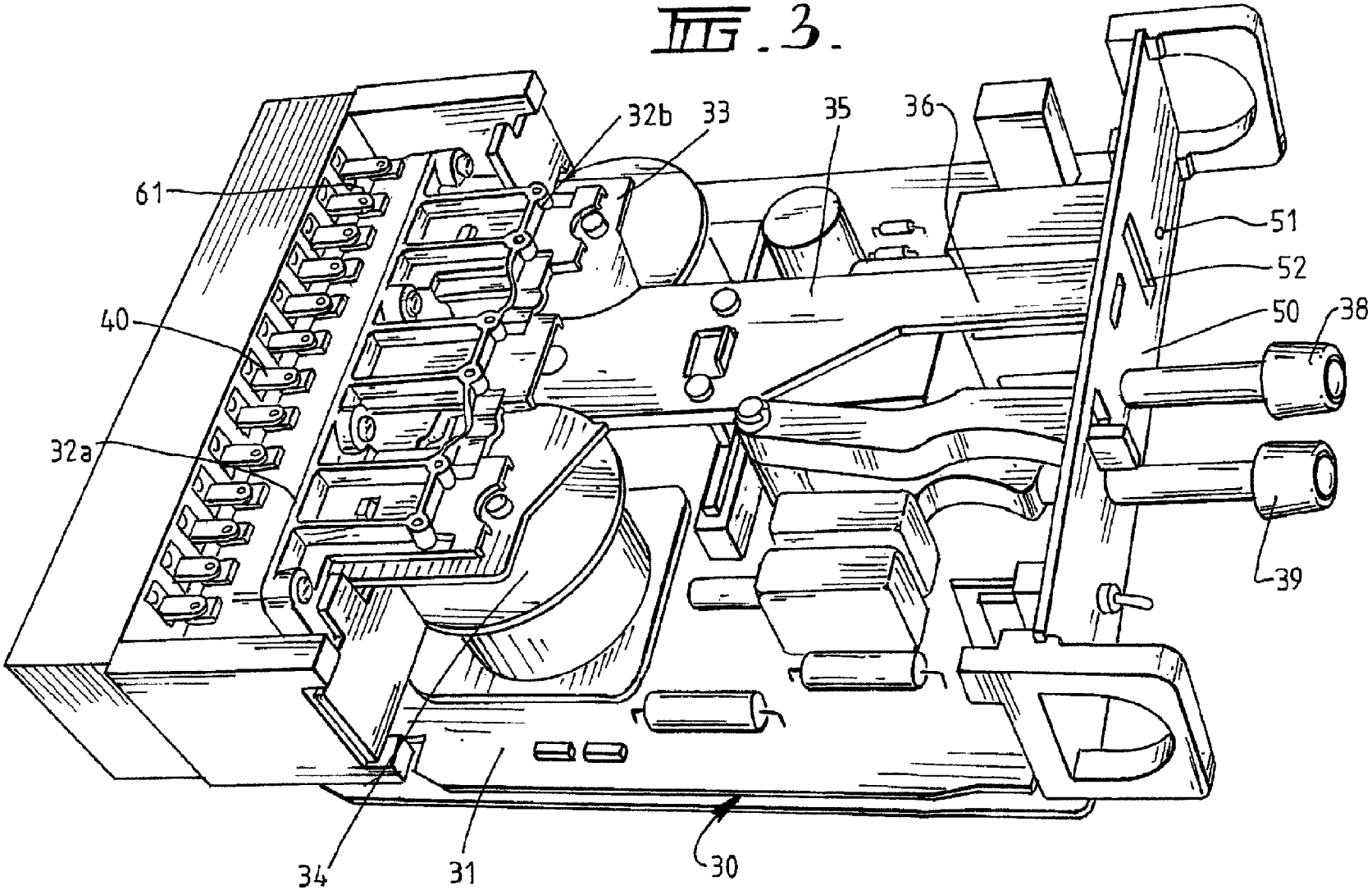
FIG. 3 is a view of the relay assembly module with one side cover removed separate from the case.

The relay 10 has a case 20 which is adapted to be located in a rack (not shown) or the like. The case is adapted to receive a relay assembly module 30.

The case 20 has on its rear surface a number of terminals 50 each of which is provided with a contact member on the internal side thereof which can engage, as will be described hereinafter, with module contacts 40, when the module is positioned within the case. This arrangement enables the case 20 to be wired into the circuit to be protected and located into the rack independently of the module.

This removes any necessity of having to wire the relay itself into the rack and also any necessity to interfere with the wiring if the relay has to be removed from or replaced into the case.

Figure 4:
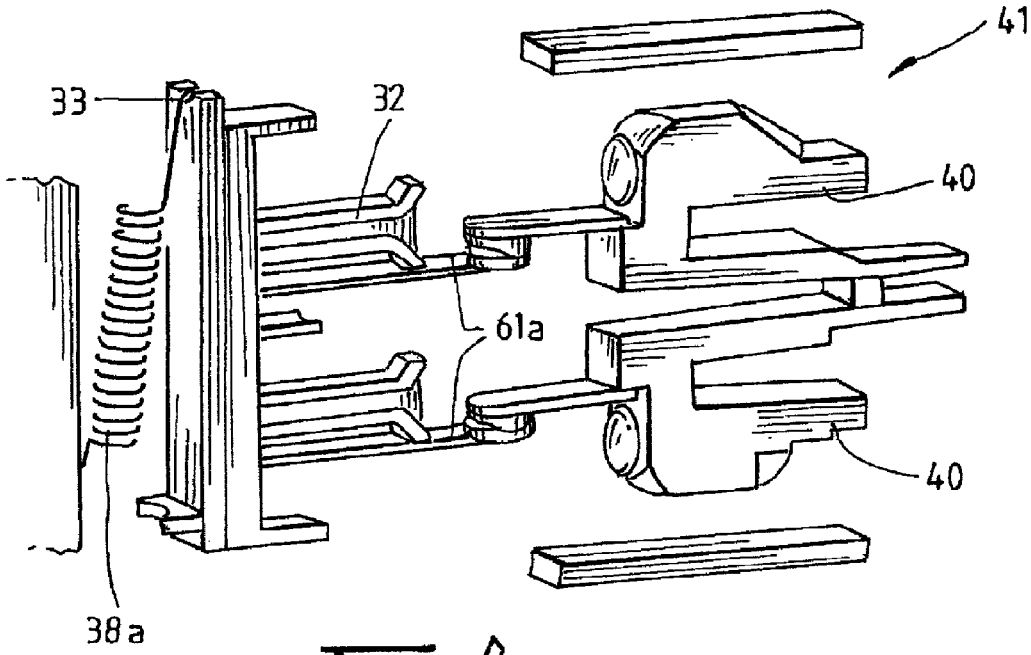
FIG. 4 is a view of the normally open contact configuration with the relay in the energised state.
Figure 5:
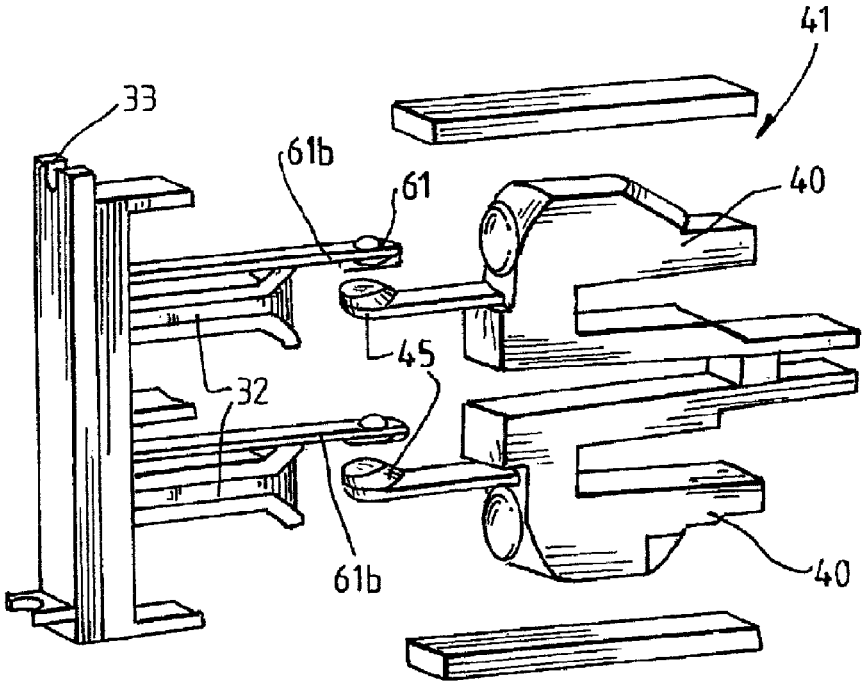
FIG. 5 is a view of the normally closed contact configuration with the relay in the energised state.

The module 30 has a number of contact mounting assemblies 41 each of which includes contacts 40, best seen from FIGS. 4 and 5, which are adapted to co-operate with the contact members on the case and which also carry the fixed contacts and their tips 60 of the relay.

The contact mounting assemblies are located in abutting relationship and are connected to the module 30.

This arrangement simplifies, during manufacture, wiring of the relay, particularly wiring in confined spaces and permits the wiring of the relay coils 34 and other components to be effected with the module being separate from the case and the operative wiring into the circuit to be protected to be effected to the case and the case be located in the rack or the like. The module with the fully wired relays can then be operatively connected simply by locating the module within the case at which time the contacts make. The assembly can then be retained in connection by screws or the like 21 connecting the case and the module.

It has been found that such an arrangement assists in ensuring reliability of connection and also enables ready service or replacement of the module without the necessity of disturbing the wiring to the circuit being protected.

The relay module 30 has a front face 50 which, as will be described hereafter, can have indicators in the form of flags 36, 37 which can indicate the status of the relay, resets 38, 39. There are also on the face other indications, shown as a coil indicator 51 and a trip counter 52. These will also be described further hereinafter.

Each relay has associated therewith -a moveable contact mounting block assembly 32 which is associated with an armature 33 which is caused move by the actuation of the coil 34 as will be described hereinafter and which is normally returned to and held in its unactuated condition by spring 38.

Each movable contact 61 attached to the modular members is formed of a U-shaped member having a pair of contact tips, one at each end of the arms of the U. The contact tips both extend in the same direction and can be used to provide normally open contacts or normally closed contacts. This can be seen from FIG. 4 where moveable contacts 61*a* are normally open contacts and on FIG. 5 where 61*b* are normally closed contacts, they are on opposite sides of their associated fixed contacts 45. These. figures show the relays in they actuated conditions so the contacts are in the opposite state than that referred to above.

There is provided a circuit board 31 which carries the electronics associated with the relay and has connected thereto the coils 34 and which can act as a carrier for a latching mechanism 35, flags such as armature flag 36 and independent flag 37 which can be seen through apertures in the front face 50 and reset mechanisms 38, 39 which extend through the front face for manipulation by an operator. This arrangement also limits the connections necessary and thus simplifies assembly.

The mounting arrangements for the fixed and moveable contacts are also connected to the circuit board.

Depending on whether the contacts are to be normally open or normally closed the contact members are arranged relative to the associated fixed contacts, which preferably have a contact tip on each face thereof, and are held in the modular member in such a way that the orientation of the fixed and moveable contacts, one relative to the other, are accurate and there does not have to be any substantial degree of calibration to ascertain that the operating parameters are as required.

By providing contacts of this type, manufacturing is simplified as it is a matter of which way the moveable contacts 61 are located so that they are on one side or the other of the fixed contacts and if they are on the outer side, they are normally spaced away from the associated fixed contact and if on the inner side in contact with the fixed contact and when the coils operate and the assembly moves towards the coils under the influence of the electro-magnet which has been formed thereon, the movable contacts will move away from the fixed contacts, if they were initially in contact therewith, or towards the fixed contacts, if they were normally spaced away therefrom.

This arrangement can readily be seen from FIGS. 4 and 5 where the normally open contacts of FIG. 4 are located beneath the mounting block 32 and the normally closed contacts of FIG. 5 are located above the mounting block. As the position of these contacts is fixed by the general arrangement, when the module is assembled, the contacts are so positioned to avoid any necessity for calibration when the relay is assembled.

It can also be preferred to provide the contacts in pairs in series. They can be in electrical connection by means of their support members which are attached to the movable portion, so that each contact is made or broken with a pair of contacts.

The illustrated arrangement of two contacts in series allows an increased current breaking capacity, particularly for inductive loads due to the increased path length.

Further for a given total contact gap, the travel required for the moving contacts to 'make' is reduced. This allows faster operation as there is less distance for the moving contacts to travel and also less bounce as the velocity (and thus the kinetic energy) of the moving contacts is lower than would be a single contact when they strike the make contact.

This serves a double-purpose.

Firstly, the current which can be interrupted can be greater than by using a single contact and, secondly, because the current flow is divided between two pairs of contacts, the electrical isolation for each contact pair is increased relative to a single contact and this minimises the likelihood of arcing.

Associated with the relay of the invention, there can be a number of different aspects which can be provided in the relay as it is manufactured.

In a first aspect, the contacts can be self-resetting.

When a voltage of the range which will operate the contacts is applied to the coil 34, the contacts are caused to be moved by the actuator 33 to the position other than the one at which they were originally located, that is, if they were normally open, they close, if they were normally closed, they open, and remain in this position until the voltage to the coil is removed, in which case, they return to their initial condition under the tension of the spring 38.

In a second application the device may be arranged that when the coil is operated and the contact positions have been assumed, the relay will remain in that position by means of a latch, regardless of the change of or lack of current passing through the coils.

This latch can be arranged to be physically released by a button or the like such as at 38,39 on the relay face 50, or it could be able to be released by passing an electric current to release the latch. If required, there could also be an arrangement whereby both a manual reset and an electrical reset could be provided so that if it was possible on occasions that the relay was remotely monitored, it could be reset from the remote position, whereas on other occasions, it could be reset physically.

As described earlier, there can be provided an armature flag 36 which follows the contacts and is visible when the relay is operated, which flag, if a resetting arrangement as previously described was used, would stay visible until the reset is effected.

There may also be provided an LED 51 which indicates when voltage is applied to the coil terminals so that the status of the relay can be readily ascertained. This is particularly useful in situations where there is not provided an armature flag to give this indication.

Also, it is possible to provide an operation counter 52 so that the work of the relay can readily be ascertained over any particular period.

It is also preferred to provide the contact tips 45 to be largely self-cleaning, by forming the tips of an arcuate shape so that as they make and break, there tends to be a degree of transverse movement between the tips on the fixed and moveable contacts. Also, operating conditions of the coil can be arranged to provide an optimum speed of making and breaking contacts, depending on the application.

It is not desirable to drive the contacts at a speed higher than an optimum speed because this will tend to cause bounce which can be detrimental to the contacts themselves and also to provide a current fluctuation in the switched circuitry.

It will be understood from the foregoing that the relay of the invention, whilst operating in a generally conventional manner, is so designed as to be able to be assembled rapidly, for accurately-located contacts to be provided without the necessity of substantial calibration after the relay is assembled and can also provide relays having a number of different alternative configurations whilst using common components, by effecting these at the time of manufacture.

We claim:

1. An electromechanical relay, comprising:

a case having a plurality of terminals with wiring fixed to said plurality of terminals from a circuit to be protected, each terminal of said plurality of terminals having a connector and a relay module capable of being received in said case, said relay module comprising cooperating connector means so that electrical contact between corresponding connectors on said case and on said relay module are electrically connected when said relay module is located within said case, wherein said corresponding connectors on said relay module each having a fixed contact for said relay module:

a movable contact associated with each said fixed contact operable by an armature on said relay module, said armature being associated with a relay coil, so that upon a required current passing through said relay coil, said armature and an associated said movable contact will be moved for making, or breaking, a connection with the associated said movable contact; and, a double-make or double-break arrangement of contacts for increasing isolation between an open said movable contact and increasing a current break-rating.

2. The electromechanical relay according to claim 1, wherein said fixed contact has a contact tip shaped to be self-cleaning.

3. The electromechanical relay according to claim 1, wherein said movable contact has a U-shape with free ends of the U-shape forms two contacts for said double-make or double-break arrangement of contacts.

4. The electromechanical relay according to claim 1, wherein said movable contact has a contact tip shaped to be self-cleaning.

5. The electromechanical relay according to claim 1, further comprising means for requiring that said electromechanical relay, once in a tripped state, is retained in the tripped state until said electromechanical relay is reset to an untripped state via means for resetting said electromechanical relay.

6. The electromechanical relay according to claim 5, wherein said means for resetting said electromechanical relay is a physical reset button.

7. The electromechanical relay according to claim 5, wherein said means for resetting said electromechanical relay is an electrical reset.

8. An electromechanical relay, comprising:

a case having a plurality of terminals with wiring fixed to said plurality of terminals from a circuit to be protected, each terminal of said plurality of terminals having a connector and a relay module capable of being received in said case, said relay module comprising cooperating connector means so that electrical contact between corresponding connectors on said case and on said relay module are electrically connected when said relay module is located within said case; and, means for requiring that said electromechanical relay, once in a tripped state, is retained in the tripped state until said electromechanical relay is reset to an untripped state via means for resetting said electromechanical relay.

9. The electromechanical relay according to claim 8, wherein said corresponding connectors on said relay module each have a fixed contact for said relay module.

10. The electromechanical relay according to claim 9, wherein said fixed contact has a contact tip shaped to be self-cleaning.

11. The electromechanical relay according to claim 9, further a movable contact associated with each said fixed contact operable by an armature on said relay module, said armature being associated with a relay coil, so that upon a required current passing through said relay coil, said armature and an associated said movable contact will be moved for making, or breaking, a connection with the associated said movable contact.

12. The electromechanical relay according to claim 11, wherein said movable contact has a contact tip shaped to be self-cleaning.

13. The electromechanical relay according to claim 8, wherein said means for resetting said electromechanical relay is a physical reset button.

14. The electromechanical relay according to claim 8, wherein said means for resetting said electromechanical relay is an electrical reset.

* * * * *